US009884214B1

(12) United States Patent
Al-Mutairi

(10) Patent No.: US 9,884,214 B1
(45) Date of Patent: Feb. 6, 2018

(54) HOSE WINDING DEVICE

(71) Applicant: Naieef F. N. M. D. Al-Mutairi, Safat (KW)

(72) Inventor: Naieef F. N. M. D. Al-Mutairi, Safat (KW)

( * ) Notice: Subject to any disclaimer, the term of this patent is extended or adjusted under 35 U.S.C. 154(b) by 0 days.

(21) Appl. No.: 15/475,104

(22) Filed: Mar. 30, 2017

Related U.S. Application Data

(60) Provisional application No. 62/406,413, filed on Oct. 11, 2016.

(51) Int. Cl.

| | |
|---|---|
| ***A62C 33/02*** | (2006.01) |
| ***B65H 54/58*** | (2006.01) |
| ***B65H 75/28*** | (2006.01) |
| ***B65H 75/40*** | (2006.01) |
| ***B65H 75/44*** | (2006.01) |

(52) U.S. Cl.
CPC ..... *A62C 33/02* (2013.01); *B65H 54/585* (2013.01); *B65H 75/28* (2013.01); *B65H 75/40* (2013.01); *B65H 75/4402* (2013.01); *B65H 75/4468* (2013.01); *B65H 75/4478* (2013.01); *B65H 75/4492* (2013.01); *B65H 2701/332* (2013.01)

(58) Field of Classification Search
CPC .. A62C 33/02; A62C 33/04; B65H 2701/331; B65H 2701/332; B65H 54/585; B65H 75/28; B65H 75/40; B65H 75/4402; B65H 75/4468; B65H 75/4478; B65H 75/4492
See application file for complete search history.

(56) References Cited

U.S. PATENT DOCUMENTS

| | | | | |
|---|---|---|---|---|
| 1,915,632 A * | 6/1933 | Marks | A62C 33/04 242/395 |
| 2,869,800 A | 1/1959 | Eden | |
| 4,057,198 A | 11/1977 | Whitfield | |
| 4,251,038 A * | 2/1981 | Gename | B65H 75/406 242/397.2 |
| 5,033,690 A | 7/1991 | McIver | |
| 5,505,404 A * | 4/1996 | Dubreuil | B65H 54/585 242/395 |
| 5,566,901 A * | 10/1996 | Wilder | B65H 54/585 242/395 |

(Continued)

FOREIGN PATENT DOCUMENTS

DE 102009010167 A1 8/2010

*Primary Examiner* — Sang K Kim
*Assistant Examiner* — Nathaniel L Adams
(74) *Attorney, Agent, or Firm* — Richard C. Litman

(57) ABSTRACT

The hose winding device has an open rectangular parallelepiped skeleton frame made of tubular members. The upper cross members at opposite ends of the frame include a lower wringer roller mounted on a shaft fixed to opposite sides of the frame and an upper wringer roller spaced above the lower wringer roller. The wringer rollers compress and flatten the fire hose as it is cranked through the wringer rollers, thereby removing any water left inside the hose. A pair of spaced apart, vertical guide rollers are mounted closely behind the wringer rollers, the four rollers being configured similar to a winch's roller fairlead, permitting the hose to be smoothly wound on the device without first straightening the hose. A hand crank is removably mounted to opposite sides of the frame halfway between opposite ends of the frame. The crank has a hose coupler retainer extending parallel to the crank's axle.

6 Claims, 10 Drawing Sheets

(56) References Cited

U.S. PATENT DOCUMENTS

| | | | | |
|---|---|---|---|---|
| 6,811,110 | B2 | 11/2004 | Tsao | |
| 8,360,353 | B2 | 1/2013 | Mosher | |
| 8,376,202 | B2 * | 2/2013 | Baker ..... | A62C 33/00<br>137/355.2 |
| 8,955,786 | B2 | 2/2015 | Motoji et al. | |
| 9,004,391 | B2 | 4/2015 | Fernandez | |
| 2011/0220756 | A1 | 9/2011 | Mosher et al. | |

* cited by examiner

HOSE WINDING DEVICE

CROSS-REFERENCE TO RELATED APPLICATION

This application claims the benefit of U.S. Provisional Patent Application Ser. No. 62/406,413, filed on Oct. 11, 2016.

BACKGROUND OF THE INVENTION

1. Field of the Invention

The present invention relates generally to storage for hoses, such as fire hoses and the like, and particularly to a hose winding device for winding fire hoses and removing remaining liquid from within.

2. Description of the Related Art

The manual winding of hoses, such as fire hoses and the like, is often a tedious and non-ergonomic operation. With fire hoses in particular, prior to the manual winding operation, the firefighter must first drain the water from the hose and then stretch out the fire hose in a linear manner. The firefighter then manually winds the hose into a convolute roll, often resting on his or her hands and knees.

Such winding of fire hoses is performed routinely by firefighting personnel. For example, after a fire fighting operation, each length of fire hose must be wound up at the scene of the fire for the return trip to the fire station. At the station, the hose must be unrolled and placed on drying racks and then wound up again for storage. In some areas, safety regulations require that all fire hoses be unwound and inspected at regular intervals, thus requiring the fire hose to then be rewound again for storage.

Although a wide variety of devices exist for the winding of hoses, cables and the like, such devices are typically ineffective for use with fire hoses. Thus, a hose winding device solving the aforementioned problems is desired.

SUMMARY OF THE INVENTION

The hose winding device is a portable device for winding hoses, such as fire hoses and the like, which also removes any remaining liquid from within as the hose is being wound, as well as flattening the hose for ease of winding. The hose winding device includes a pair of substantially U-shaped frame members, each having a closed upper end and an open lower end, and a base. The base is adapted for positioning on a support surface, such as the ground or the like, and the open lower ends of the pair of substantially U-shaped frame members are secured thereto.

An axle is rotatably mounted to, and extends between, the closed upper ends of the pair of substantially U-shaped frame members. At least one set of first and second rollers is mounted to, and extends between, the closed upper ends of the pair of substantially U-shaped frame members. The first roller has a pair of opposed ends respectively rotatably secured to the pair of substantially U-shaped frame members. The second roller has a first end pivotally secured to one of the pair of substantially U-shaped frame members and a second end releasably secured to other one of the pair of substantially U-shaped frame members. The first roller is vertically spaced apart from the second roller such that a hose to be wound about the axle is squeezed between the first and second rollers to remove the remaining liquid from therein.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The hose winding device has an open rectangular parallelepiped skeleton or box-shaped frame made of tubular members. The upper cross members at opposite ends of the frame include a lower wringer roller mounted on a shaft fixed to opposite sides of the frame and an upper wringer roller spaced above the lower wringer roller, the upper roller being mounted on a shaft pivotally attached to one side of the frame and releasably latched to the opposite side of the frame so that the upper roller may be pivoted upward to pass the coupler of a fire hose through the wringer rollers. The wringer rollers compress and flatten the fire hose as it is cranked through the wringer rollers, thereby removing any water left inside the hose, much like a wringer clothes washing machine. A pair of spaced apart, vertical guide rollers are mounted closely behind the wringer rollers, the four rollers being configured similar to a winch's roller fairlead, permitting the hose to be smoothly wound on the device without first straightening the hose. The guide rollers at one end of the frame may be more widely spaced apart than the guide rollers at the opposite end so that the device can be used to wind fire hoses of different diameter. A hand crank is removably mounted to opposite sides of the frame halfway between opposite ends of the frame. The crank has a hose coupler retainer extending parallel to the crank's axle.

After the hose has been wound on the crank's axle, the crank may be removed from the frame and the crank may be slipped off the hose so that the wound hose may be stored for its next use, while the device may be used to wind another hose.

Figure 1:
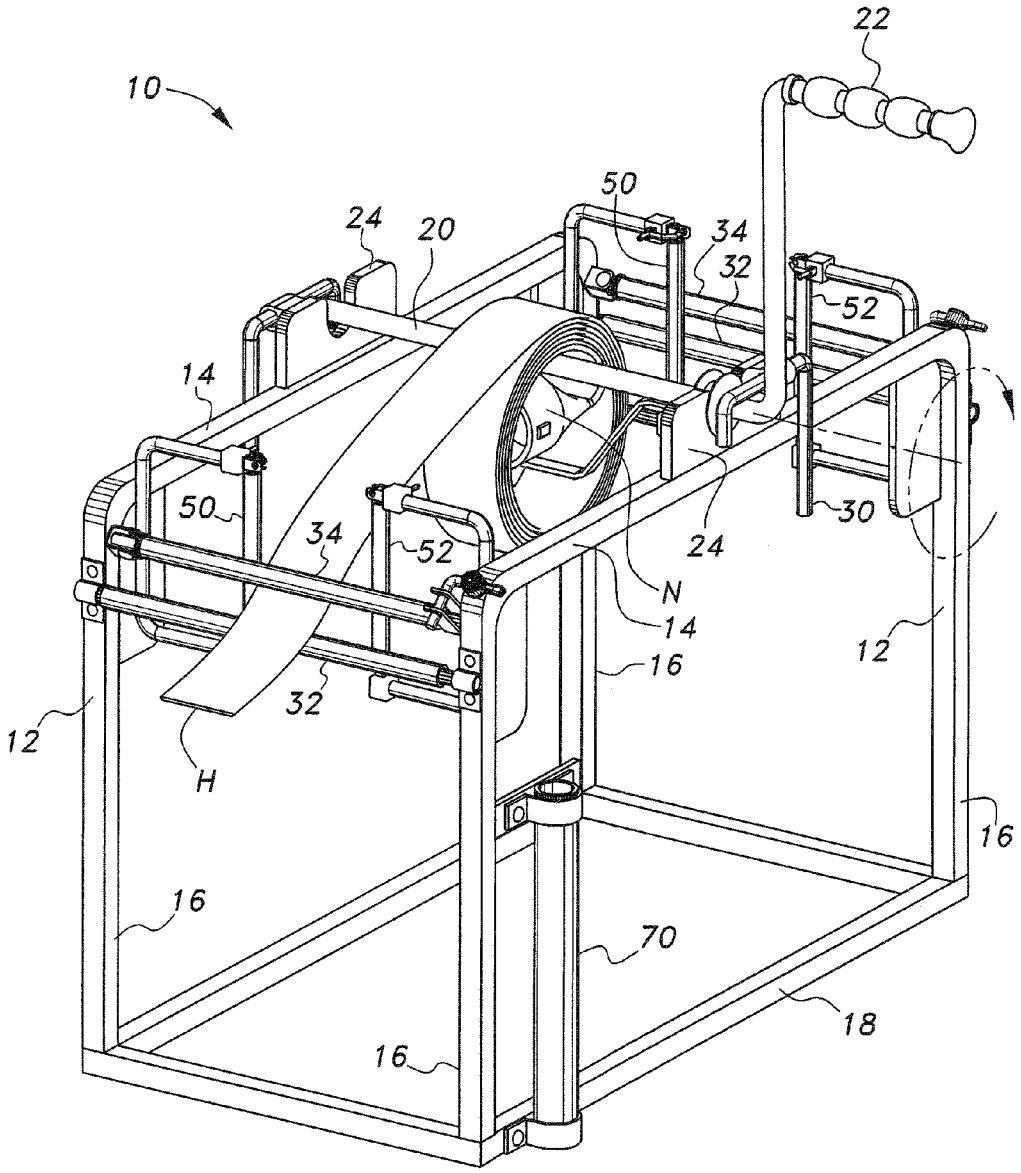
FIG. 1 is an environmental, perspective view of a hose winding device according to the present invention.
Figure 2:
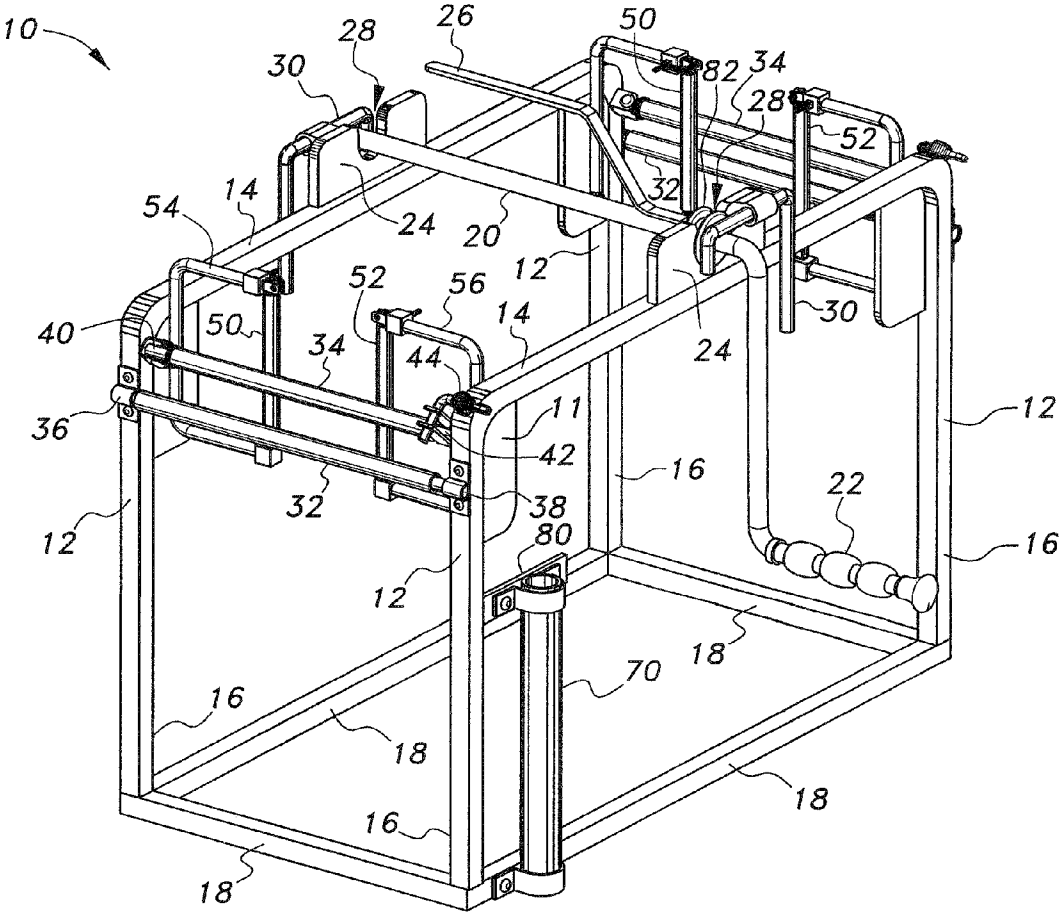
FIG. 2 is a perspective view of the hose winding device of FIG. 1.

In more detail, referring to FIG. 1, the hose winding device 10 is a portable device for winding hoses, such as exemplary fire hose H, and which also removes any remaining liquid from within as the hose H is being wound, as well as flattening the hose H for ease of winding and storage. As shown in FIGS. 1 and 2, the hose winding device 10 may include a pair of substantially U-shaped frame members 12, each having a closed upper end 14 and an open lower end 16, and a base 18. The base 18 is adapted for positioning on a support surface, such as the ground or the like, and the open lower ends 16 of the pair of substantially U-shaped frame members 12 are secured thereto, as shown. It should be understood that the overall frame structure of hose winding device 10, including the pair of substantially U-shaped frame members 12 and the substantially rectangular base 18, is shown for exemplary purposes only, and that the overall configuration and relative dimensions thereof may vary.

A hand crank 22 having an axle 20 is rotatably mounted to, and extends between, the closed upper ends 14 of the pair of substantially U-shaped frame members 12 about halfway between opposing ends of the frame. As best seen in FIG. 2, a pair of mounting lugs 24 are respectively secured to the closed upper ends 14 of the pair of substantially U-shaped frame members 12 for releasably receiving and supporting the axle 20. It should be understood that the mounting lugs 24 are shown for exemplary purposes only, and may have any desired overall configuration and relative dimensions. Preferably, each mounting lug 24 has a fork 28 defined therein for receiving a respective end of the crank axle 20, as shown, allowing the ends of axle 20 to rotate freely therein.

Figure 3:
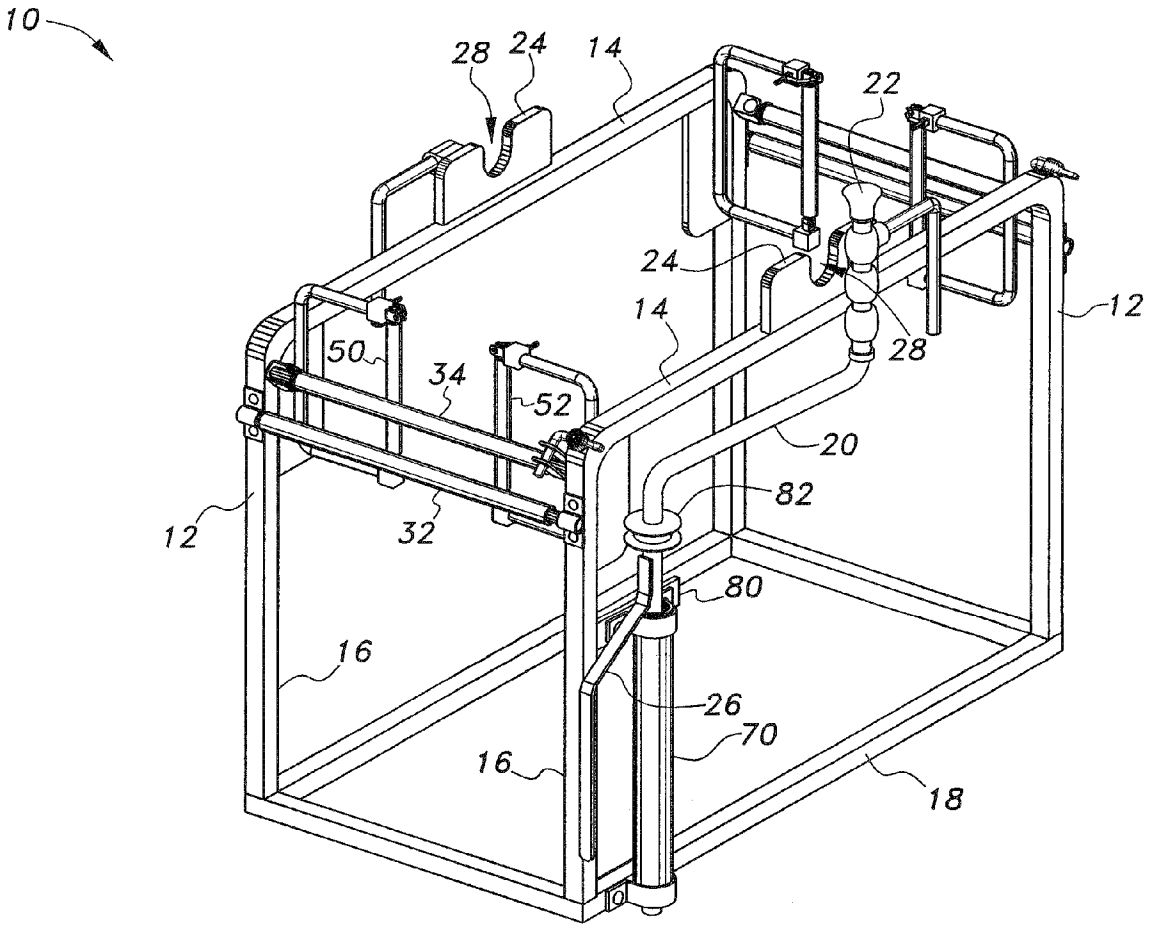
FIG. 3 is a perspective view of the hose winding device of FIG. 1 with the crank shown in a stored position.

A crank handle 22 is mounted on one end of axle 20 for selectively driving rotation thereof. As shown in FIG. 1, driven rotation of axle 20 is used to wind the hose H. As shown in FIGS. 1-3, the axle 20 is removable, thus allowing it to be removed from mounting brackets 24 for easier transport and storage of the hose winding device 10. Preferably, as best seen in FIG. 3, a receptacle 70 is provided for removably receiving the axle 20 when axle 20 is removed from the pair of mounting brackets 24. The receptacle 70 is shown as being substantially cylindrical, with a lower end mounted on base 18 and an upper end supported by a support bar 80, although it should be understood that the receptacle 70 may have any suitable overall configuration and relative dimensions, and may be positioned in any desired location on or near the frame of the hose winding device 10. Further, as best seen in FIG. 3, the crank axle 20 may have at least one rotational guide member 82 (e.g., a disk having an annular recess defined in its rim) for secure mounting within the fork 28 of at least one of the mounting lugs 24.

Figure 4:
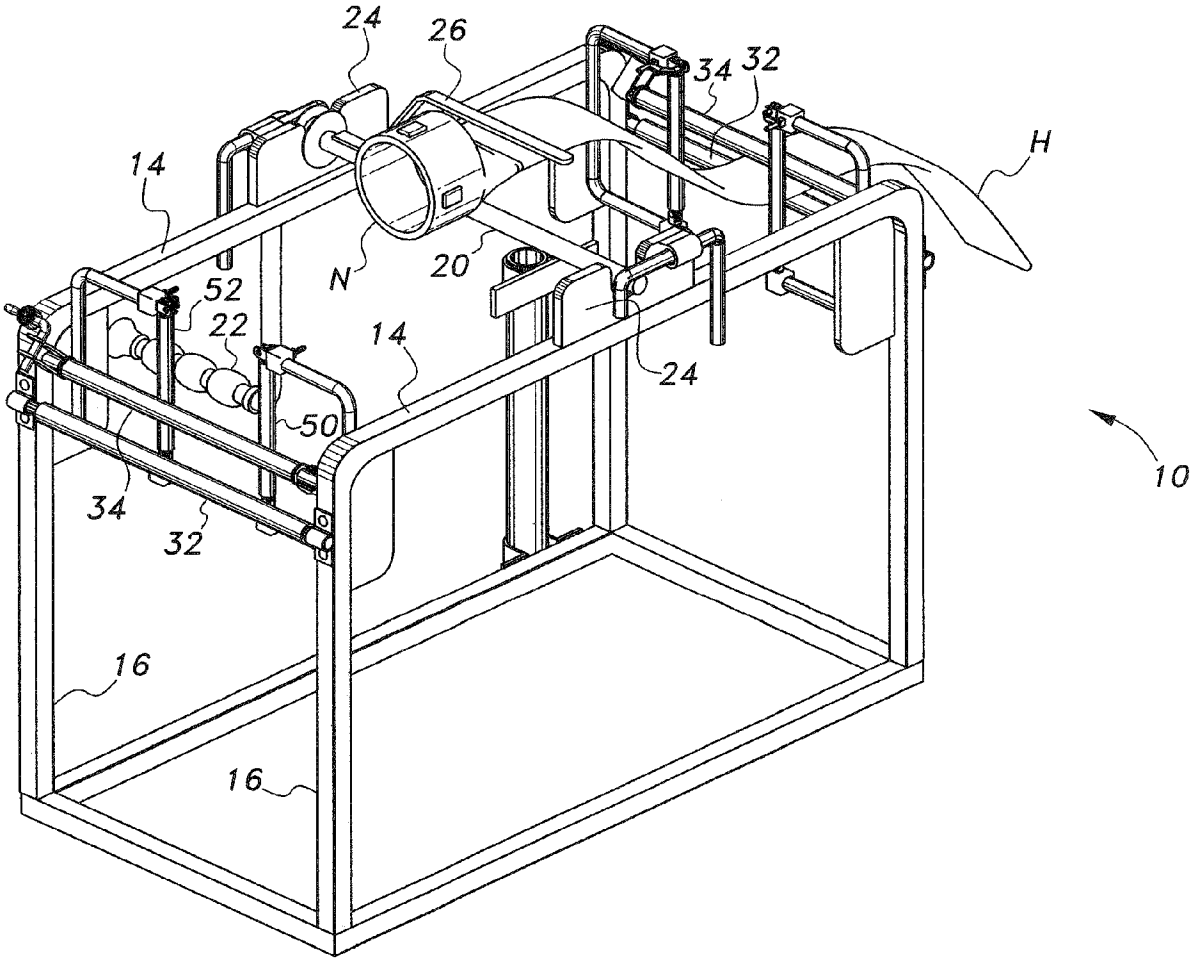
FIG. 4 is an environmental, perspective view of the hose winding device of FIG. 1, showing the hose being retained on the crank by the retainer.
Figure 5A:
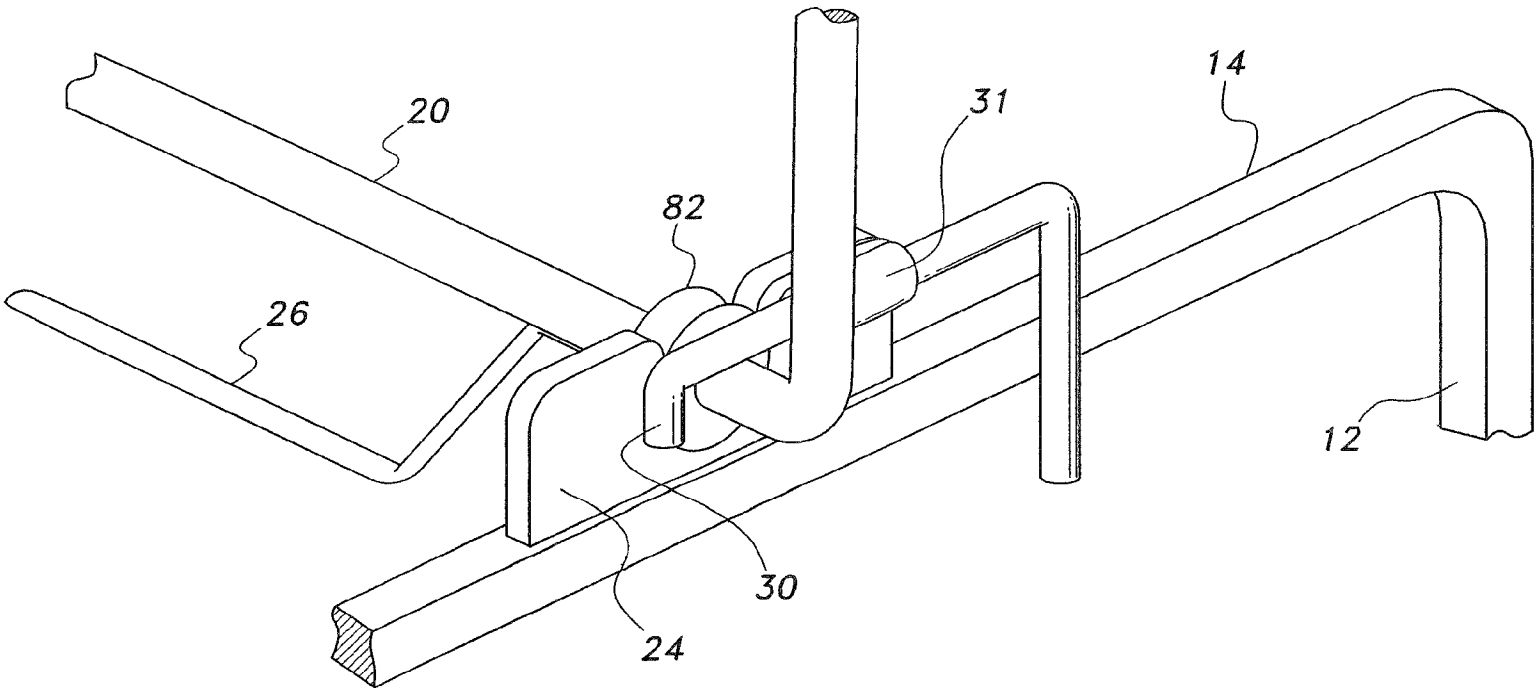
FIG. 5A is a partial perspective view of the hose winding device of FIG. 1, showing a slidable locking bar for retaining the crank on the device frame.
Figure 5B:
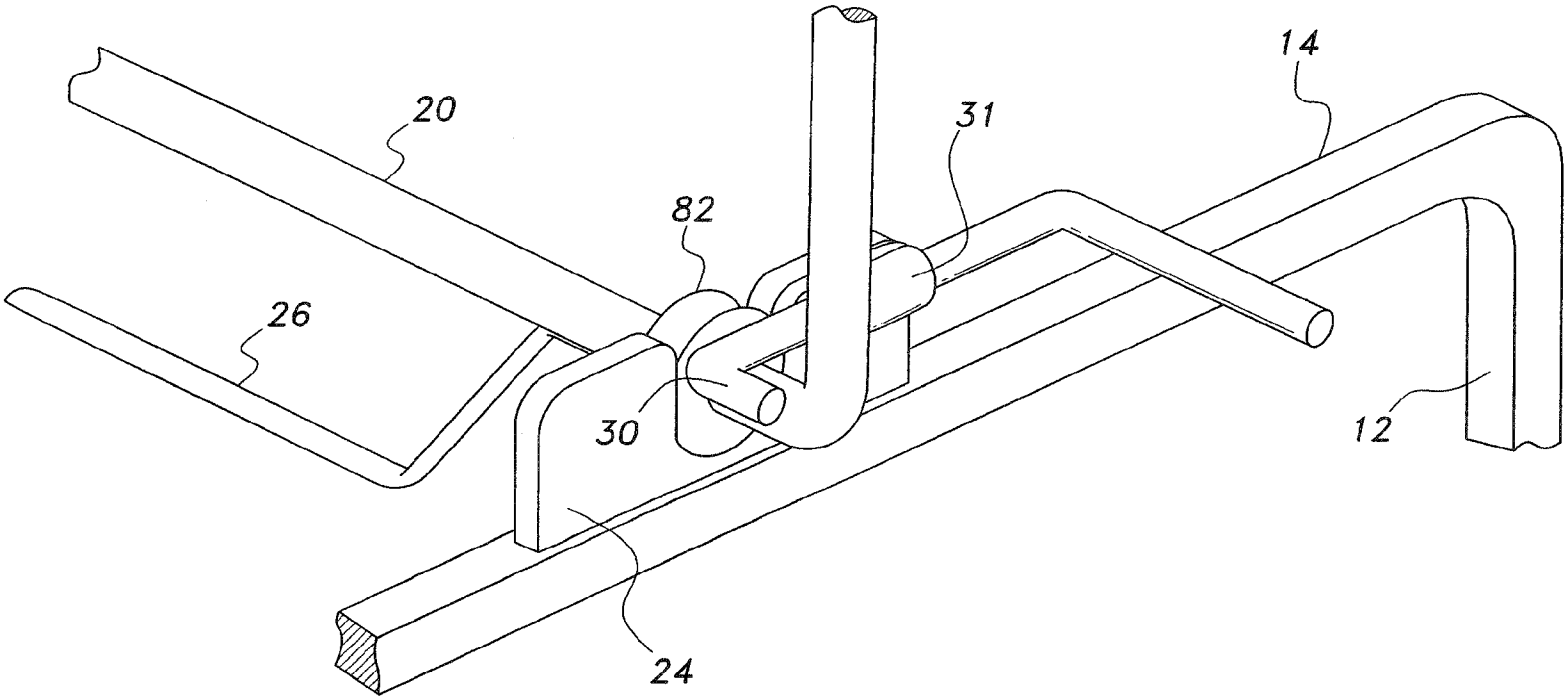
FIG. 5B is a partial perspective view of the hose winding device of FIG. 1, showing the slidable locking bar with the hook pivoted up parallel to the shaft of the crank.
Figure 5C:
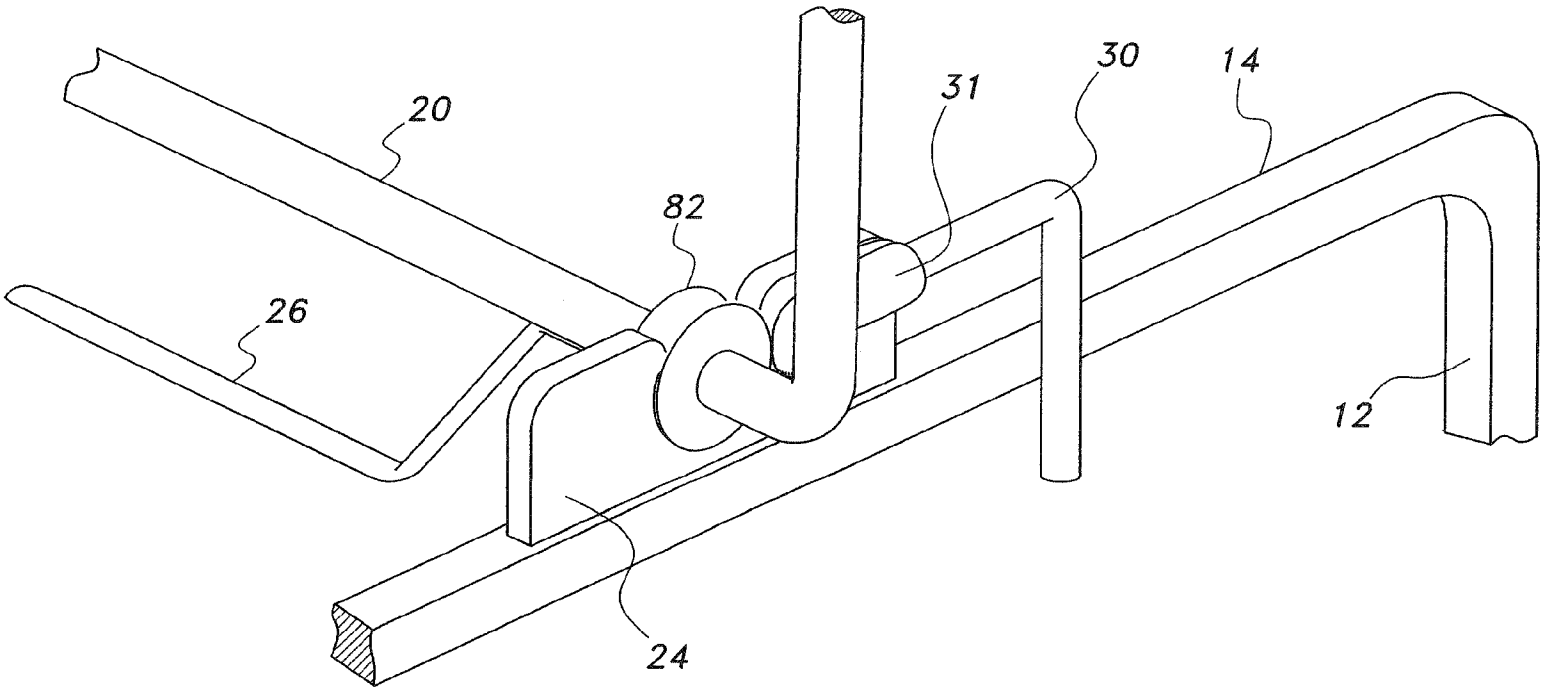
FIG. 5C is a partial perspective view of the hose winding device of FIG. 1, showing the slidable locking bar in an unlocked position.

As best shown in FIGS. 2 and 4, a coupler retaining bar 26 is mounted on the crank axle 20 for releasably securing a coupler N (e.g., a coupler for securing the hose to a fire hydrant or the water tank of a tanker fire truck) of the hose H between the retaining bar 26 and the axle 20. The retaining bar 26 has an open-ended elongate portion extending parallel to the crank axle 20 and a bent portion having an end rigidly fixed to the crank axle to offset the elongate portion. Further, as shown in FIGS. 2, 5A, 5B and 5C, a pair of slidable locking bars 30 are preferably respectively slidably mounted in a sleeve 31 of the pair of mounting lugs 24 for releasably locking the ends of axle 20 within the respective forks 28 of the pair of mounting lugs 24.

Figure 6A:
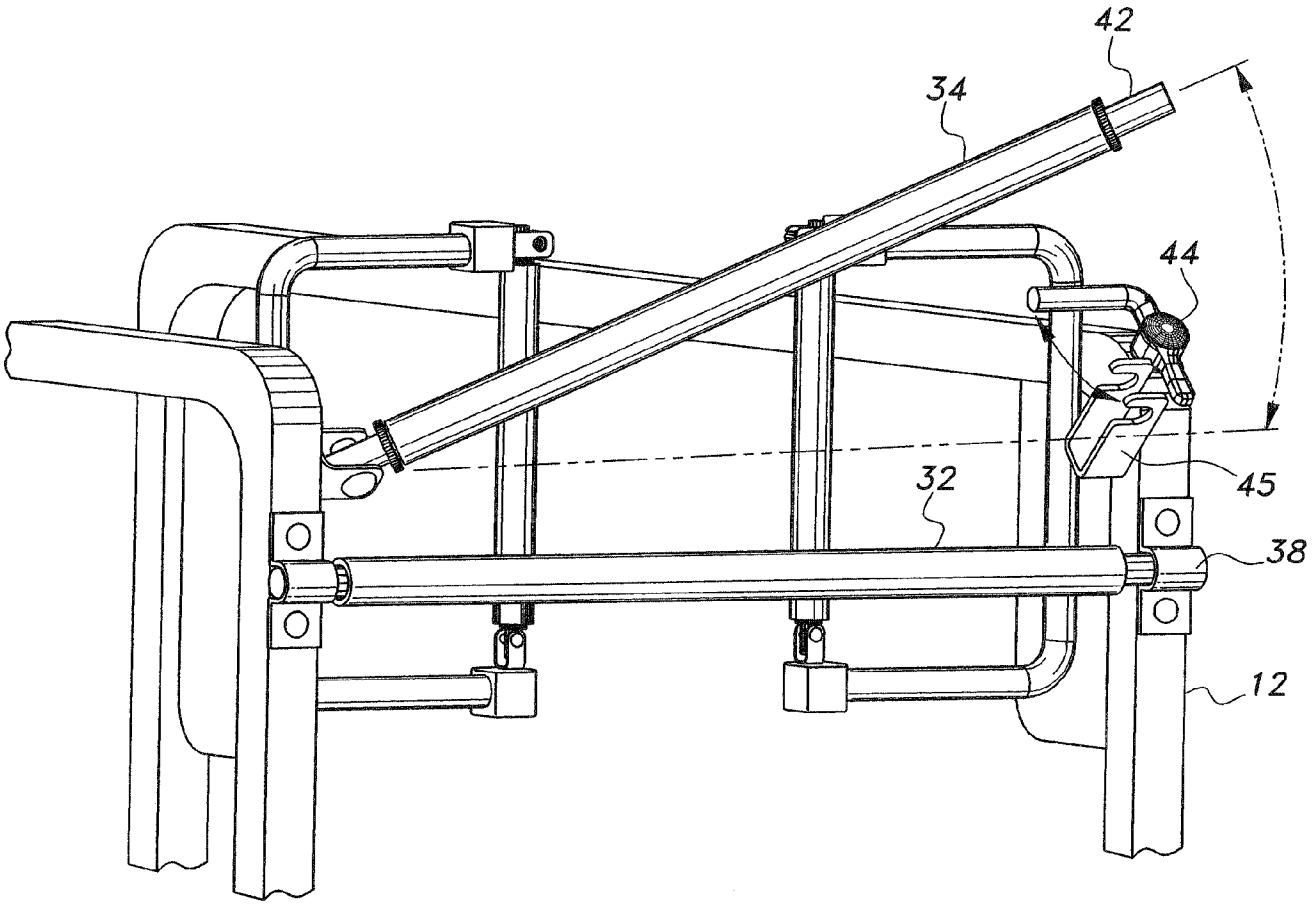
FIG. 6A is a partial perspective view of the hose winding device of FIG. 1, showing the upper wringer roller pivoted upward to allow insertion of the hose coupler through the wringer rollers.
Figure 6B:
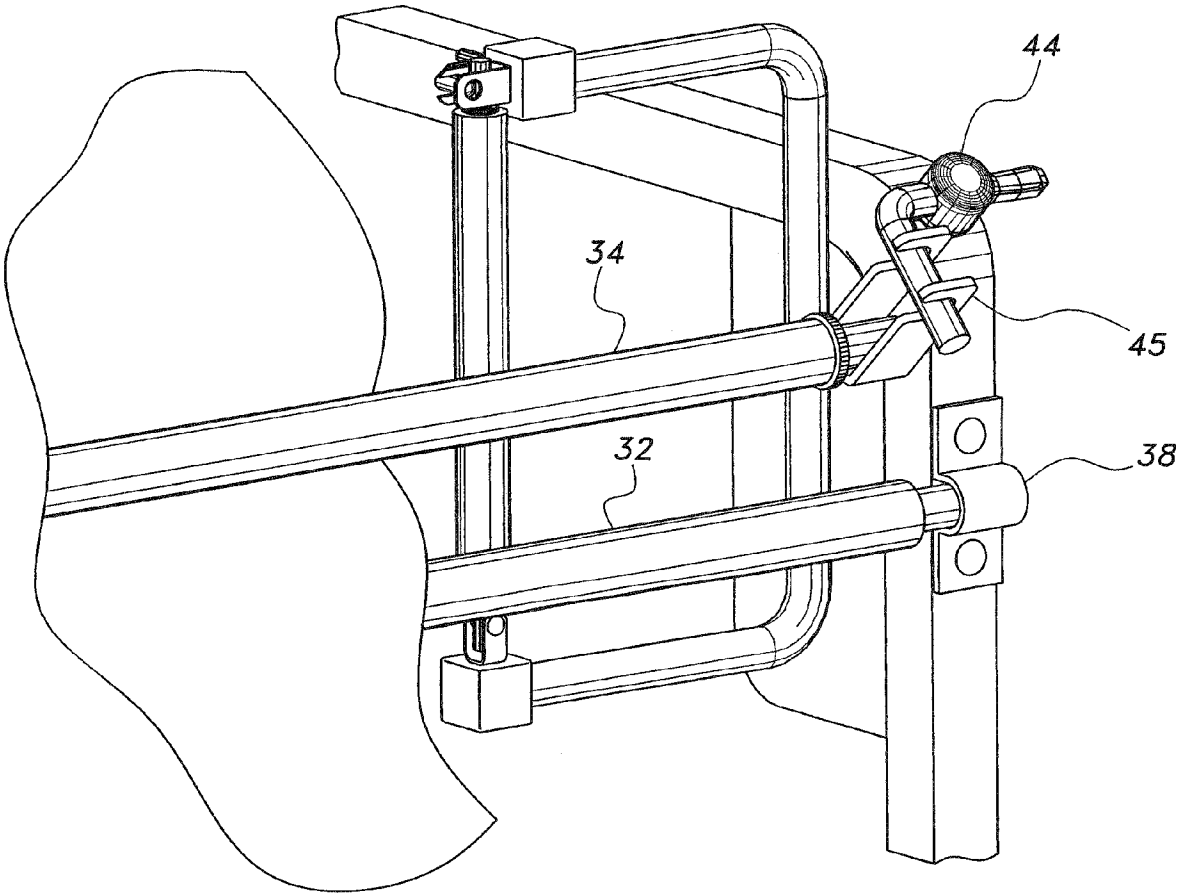
FIG. 6B is a partial perspective view of the hose winding device of FIG. 1, showing the upper wringer roller in a locked position.

As best shown in FIG. 2, at least one pair of lower and upper wringer rollers 32, 34 is mounted to, and extends between, the closed upper ends 14 of the pair of substantially U-shaped frame members 12. The lower wringer roller 32 has a pair of opposed ends 36, 38 respectively rotatably secured to the pair of substantially U-shaped frame members 12. As shown in FIG. 6A, the upper wringer roller 34 has a first end 40 pivotally attached to one of the pair of substantially U-shaped frame members 12 and a second end 42 releasably secured to other one of the pair of substantially U-shaped frame members 12. As shown in FIGS. 6A and 6B, the free end 42 of upper wringer roller 34 is preferably received by a saddle bracket 45 fixed to the corresponding frame member 12 and selectively locked therein by a latch 44 pivotally mounted on the frame member 12. It should be understood that the saddle bracket 45 and latch 44 are shown for exemplary purposes only, and that the free end 42 of second roller 34 may be releasably secured to the corresponding frame member 12 by any suitable type of selectively lockable fastener.

As shown, the lower wringer roller 32 is vertically spaced apart from the upper wringer roller 34 such that the hose H to be wound about the crank axle 20 is squeezed between the lower and upper wringer rollers 32, 34, as shown in FIGS. 1 and 4, to remove the remaining liquid from within the hose H and to flatten the hose H. Preferably, as shown, a second set of first and second rollers 32', 34' is mounted on the opposite end of the pair of substantially U-shaped frame members 12 and positioned substantially symmetrically with the first set of first and second rollers 32, 34, and operating in an identical manner. This allows the hose winding device 10 to be used from either end without the need for turning the device 10 or unnecessarily manipulating the hose H.

Additionally, as best seen in FIG. 2, at least one pair of vertical guide rollers 50, 52 are respectively mounted to the pair of substantially U-shaped frame members 12 adjacent the wringer rollers 32, 34 and 32', 34'. As shown, the at least one pair of side rollers 50, 52 are horizontally spaced apart from one another for guiding the hose H to be wound about the axle 20. A pair of C-shaped brackets 54, 56 is mounted on the pair of substantially U-shaped frame members 12 for supporting the guide rollers 50, 52.

Figure 7:
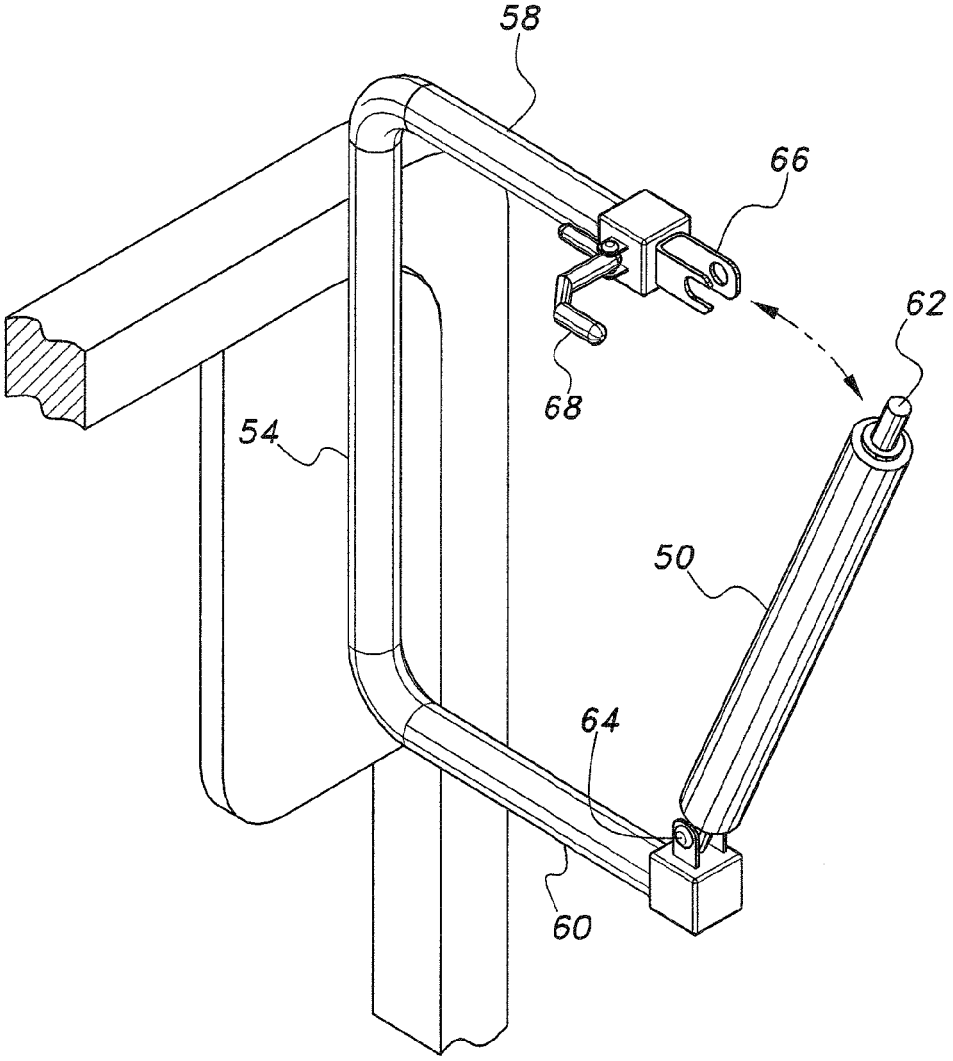
FIG. 7 is a partial perspective view of the hose winding device of FIG. 1, showing one of the vertical guide rollers pivoted away from its mounting arm.

FIG. 7 shows one guide roller 50 mounted on its bracket 54, although it should be understood that guide roller 52 operates in a similar manner with respect to its bracket 56. As shown, the guide roller 50 has an upper end 62 and a lower end 64. The lower end 64 of the guide roller 50 is pivotally attached to the bottom arm 60 of the C-shaped bracket 54, and the upper end 62 is releasably secured to the upper arm 58 of the C-shaped bracket 54. As shown in FIG. 7, the upper end 62 of the guide roller 50 is preferably received by a retainer 66 secured to the upper arm 58 of the C-shaped bracket 54 and selectively locked therein by a pivotal latch 68. It should be understood that retainer 66 and latch 68 are shown for exemplary purposes only, and that the upper end 62 of the guide roller 50 may be releasably secured to the upper arm 58 of the C-shaped bracket 54 by any suitable type of selectively lockable fastener. The pivoting of the guide roller 50 permits the coupler end of the hose H to be placed between the vertical guide rollers 50, 52 before winding. As shown in FIG. 1, the pair of guide rollers 50, 52 are spaced apart, depending on the width of the fire hose H, and provide a guide for maintaining the hose H in an aligned positioned with the center of the crank axle 20.

Preferably, as shown, a second pair of guide rollers 50', 52' are mounted on the opposite end of the pair of substantially U-shaped frame members 12, positioned substantially symmetrically with the first pair of guide rollers 50, 52, and operating in an identical manner. The guide rollers 50, 52 may be spaced wider apart than the guide rollers 50', 52' so that the device may be used to wind fire hoses of different diameter, depending on which end is used to wind the hose. This also allows the hose winding device 10 to be used from either end without the need for turning the device 10 or unnecessarily manipulating the hose H. On each side, the wringer rollers and the guide rollers are configured substantially similar to a winch's roller fairlead, permitting the hose to be smoothly cranked and centered on the crank axle 20, even if the hose has not been straightened before winding.

In use, the upper wringer roller 34 or 34' is unlatched and pivoted upward while drawing the hose H over the lower wringer roller 32 or 32' and hooking the hose coupler N behind the coupler retainer bar 26, pivoting the guide roller 50 open to insert the coupler end of the hose between the vertical guide rollers 50, 52 before winding and then latching the guide roller 50. The upper wringer roller 34 or 34' is then pivoted downward and latched in the saddle bracket 45 to secure the hose H between the wringer rollers 32, 34 or 32', 34'. The crank is then manually rotated using the crank handle 22 to wind the hose H on the crank axle 20. When the hose H is fully wound, the locking bars 30 are rotated and slid across the lugs 24 to release the crank, permitting the crank to be detached from the frame with the hose H wound thereon. Since the coupler retainer bar is attached to the crank axle 20 at one end but open at the other end, the hose H can be slid off the crank and the crank can be stored in the receptacle 70 or mounted on the frame to wind another fire hose H.

It is to be understood that the present invention is not limited to the embodiments described above, but encompasses any and all embodiments within the scope of the following claims.

I claim:

1. A hose winding device, comprising:

a pair of substantially U-shaped frame members, each of the U-shaped frame members having a closed upper end, an open lower end and opposed ends;

a base adapted for positioning on a support surface, the open lower ends of the U-shaped frame members being fixed to the base, the U-shaped frame members being parallel and opposite each other;

a crank having a handle and an axle rotatably mounted to and extending between the closed upper ends of the pair of U-shaped frame members;

a pair of lower and upper wringer rollers mounted to and extending between the closed upper ends of the pair of U-shaped frame members at opposed ends thereof, each pair of rollers having the lower wringer roller having a pair of opposed ends rotatably secured to the pair of U-shaped frame members, the upper roller having a first end pivotally attached to one of the U-shaped frame members about a first axis and a second end releasably fastened to the opposing U-shaped frame member, wherein the upper roller pivots solely within a plane transverse to the first axis, the wringer rollers being vertically spaced apart such that a hose to be wound about the crank axle is squeezed between the wringer rollers to flatten the hose and remove any liquid remaining in the hose;

a latching fastener attached to the opposing U-shaped frame member for releasably fastening the second end of the upper wringer roller;

a pair of vertical guide rollers mounted to the opposing pair of U-shaped frame members adjacent each of the pair of wringer rollers, the guide rollers being horizontally spaced apart from one another for guiding the hose to be wound about the axle;

a pair of C-shaped brackets mounted on the opposing pair of U-shaped frame members at the opposed ends of the U-shaped frame, the vertical guide rollers being mounted on the C-shaped brackets; and wherein each of the pairs of vertical guide rollers has an upper end and a lower end, the lower end thereof being pivotally attached to a lower arm of a corresponding one of the C-shaped brackets about a second axis, the upper end being releasably fastened to an upper arm of the corresponding one of the C-shaped brackets, wherein the vertical roller pivots solely within a plane transverse to the second axis.

2. The hose winding device as recited in claim 1, wherein said base is rectangular.

3. The hose winding device as recited in claim 1, further comprising a pair of mounting lugs secured to the closed upper ends of the opposing U-shaped frame members, said crank axle having opposing ends releasably receiving and supporting the ends of said crank axle.

4. The hose winding device as recited in claim 3, wherein each of said mounting lugs has a locking bar slidably mounted thereon for releasably locking said crank axle within said lug.

5. The hose winding device as recited in claim 4, further comprising a receptacle mounted on one of said U-shaped frame members for removably receiving the crank when the crank is removed from the pair of mounting lugs.

6. The hose winding device as recited in claim 1, further comprising a coupler retaining bar mounted on said crank axle, the retaining bar having an open-ended elongate portion extending parallel to said crank axle and a bent portion fixed to said crank axle and offsetting the elongate portion from said crank axle, the retaining bar being adapted for hooking a coupler of a fire hose between the retaining bar and the axle to temporarily retain the hose on said crank axle while winding the hose.

* * * * *